United States Patent [19]

Blume

[11] 4,205,398

[45] Jun. 3, 1980

[54] MEDICAL EXAMINATION ROBE

[76] Inventor: Patricia Blume, 2212 Eastlake Rd., Timonium, Md. 21093

[21] Appl. No.: 28,355

[22] Filed: Apr. 9, 1979

[51] Int. Cl.[2] ..... A41B 9/00

[52] U.S. Cl. ..... 2/114; 2/DIG. 7

[58] Field of Search ..... 2/114, 74, DIG. 7, 243 B, 2/105

[56] References Cited

U.S. PATENT DOCUMENTS

| | | | |
|---|---|---|---|
| 2,522,023 | 9/1950 | Eason | 2/74 |
| 2,707,282 | 5/1955 | Paterson | 2/DIG. 7 |

*Primary Examiner*—Werner H. Schroeder

*Assistant Examiner*—Doris L. Troutman

*Attorney, Agent, or Firm*—Samuel Lebowitz

[57] ABSTRACT

A shift-type strapless examining robe designed to give a female patient a sorely needed psychological lift during the physical examination. The upper portion of the robe is provided with elongated openings of different lengths at the front and back thereof to afford the physician ready access to the parts of the body requiring examination. Also the lower portion is flared extensively and includes a pair of pleats at the front of the robe adjacent to the bottom thereof which forms a continuous bottom section without any openings functioning as a tent-like covering during the pelvic examination, without need for any separate additional covering sheets.

9 Claims, 4 Drawing Figures

MEDICAL EXAMINATION ROBE

This invention relates to a patient's examination robe or gown, and particularly to a gown for use by a female patient undergoing a medical examination.

It is the object of the present invention to provide an improved examining robe or gown which is adapted to be worn by a patient in the course of undergoing examination by a physician.

It is a further object of the present invention to provide a launderable examining robe which may be worn comfortably by the patient upon disrobing, and one which will afford ready access to all parts of the body for the necessary examinations and which, at the same time, will afford the patient a feeling of relaxation and dignity, which is not always easy to attain in view of the physical as well as psychological stresses to which the patient is subjected during the examining period.

The robe of the instant invention aims to improve upon the many forms of examining robes which have been designed heretofore and many of which sought the same objectives as set forth above. These examining robes have been made of inexpensive disposable sheet material, as well as of launderable textile fabrics. They have been provided with closures and fasteners of all types, as well as with special features serving to facilitate the examination of the patient. The following patents are illustrative of art showing such examining robes and gowns: U.S. Pat. Nos. Re. 27,348, May 9, 1972; 2,707,282, May 3, 1955; 3,160,891, Dec. 12, 1964; 3,490,072, Jan. 20, 1970; and 3,751,730, Aug. 14, 1973.

None of the patents of the prior art discloses an examining robe having the attractive esthetic features of the gown in accordance with the invention, which is capable of giving the patient a highly desirable "lift" and which, at the same time incorporates in its design an exceptionally generous amount of material, so that upon the approach of the culmination of the examination, which in most instances is the most distasteful part thereof, namely, the pelvic examination, the robe provides adequate shielding so that the physician may perform this part of the examination without need for any extraneous covering beyond that afforded by the robe at the lower portion thereof.

Other objects and purposes will appear from the detailed description of the invention following hereinafter, taken in conjunction with the accompanying drawings, wherein FIG. 1 is a front view of the robe in accordance with the invention;

Figure 1:
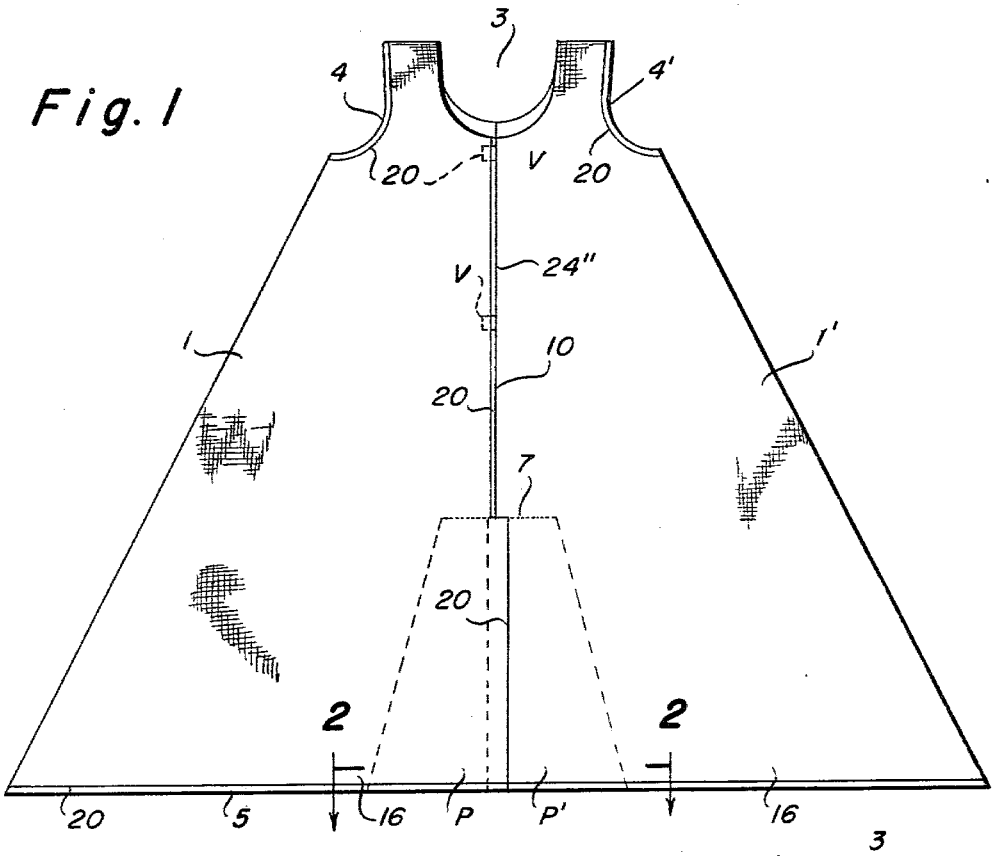
Figure 2:
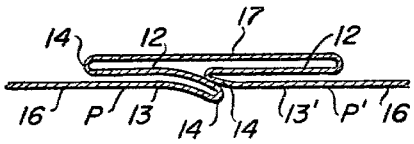
FIG. 2 is a horizontal sectional view along line 2-2 of FIG. 1.

In the drawing is shown a shift-type strapless robe or gown in accordance with the invention which may be used for patients of different sizes, and is preferably of a wash-and-wear textile fabric of different colors, such as orange, yellow, blue and green, to enhance the attractiveness of the robe.

The gown may be sewn by uniting a pair of front panels 1 and 1' with a pair of rear panels 2 and 2' along side seams with a central cut-out portion 3 at the top thereof for the head, and armholes 4 and 4' on the sides.

The marginal edges of the latter and of opening 3, as well as the bottom 5 of the garment are bound with tape of contrasting color to enhance the appearance of the robe and to ensure its durability, as a result of the absence of raw edges.

The free edges of the front panels 1 and 1' at the center of the garment at the upper portion provide an elongated opening 10 which may be readily closed or separated by providing VELCRO type patches V at different levels of the separable opening, as is well known in the art. The opening 10 terminates below the mid-portion of the garment at about the pubic area of the patient, and affords the physician the opportunity to perform the necessary examinations of the chest, abdomen and the pubic area of the patient. The lower end of opening 10 coincides approximately with the pubic area, whereat is provided a pair of front divergent pleats P, P' extending from the horizontal line of stitching 7, to prevent the complete opening of the front of the examining robe or gown. The complementary pleats P, P' each serves to extend the bottom central portion of the robe 17 through overlying layers 12 and 13, joined at the fold line 14 before continuing the extension of the front fabric 16 to the sides of the robe.

The pleated arrangement P, P' at the lower portion of the front of the robe serves to prevent the complete opening of the front, but nevertheless extends the bottom edge of the robe to a degree that the robe not only functions as an examination robe, but also as a covering sheet between the patient and the physician so that the execution of the pelvic examination may be undertaken without unnecessary embarrassment to the patient by recourse to additional sheeting which, in most instances, is necessary when conventional examining robes are used.

This advantageous function is attainable by providing a pleat of relatively short length at the front, for example, eighteen or nineteen inches, while the main opening 10 between the junction line 7 and the top of the front is approximately twenty-four inches.

The extensive flaring of the robe from the bottoms of the arm-holes to the bottom of the robe permits the latter to assume a natural "hang", with a capability of simulating a tent-like appearance if the front and back are each sixty to sixty-two inches in width along the bottom edge. Furthermore, the capability of distension of the pleats P and P', each of which may be about eight inches in width at the bottom, increases the length of the hem line of the robe beyond four yards, so that the same may function as a tent or covering sheet without need for any extraneous sheets.

Figure 4:
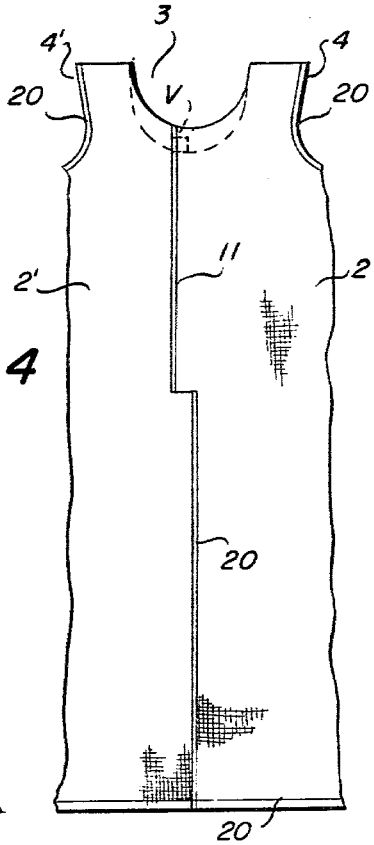
FIG. 4 is a rear view of the central portion of the robe.
Figure 3:
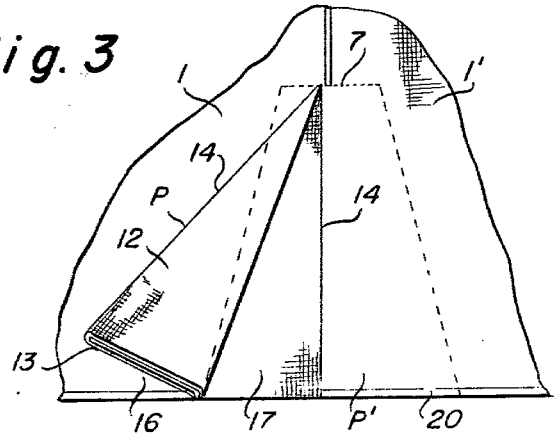
FIG. 3 is a front view of the lower portion of FIG. 1 with one of the pleats folded out to illustrate a distinctive feature of the invention.

As shown in FIG. 4, the elongated opening 11 between the upper portions of the free edges of the rear panels 2 and 2' is of lesser length than the front opening 10. Opening 11 may extend to the lumbar region of the back, which upon opening of the complementary VELCRO type fasteners on the respective free edges of the panels at the top of the robe, affords the exposure necessary for examination of the back and chest portions of the body.

The length of the opening 11 may approximate fourteen inches in comparison to the length of the opening 10 of twenty-four inches.

The edges of the robe at the openings 3, 4 and 4', as well as along the bottom and elongated openings 10 and 11, may be bound with an ornamental tape 20 to enhance the appearance of the robe and to extend its useful life despite repeated launderings.

I claim:

1. In a shift-type strapless examining robe for female medical patients having front and back portions extending downwardly from shoulder supports with arm-holes at the outer edges of the latter and a pair of elongated openings extending centrally and only partially from the top of said portions which flare from the bottoms of said arm-holes to a tent-like continuous portion at the bottom of the robe, (a) the front portion of said garment comprised of two panels of sheet material separable at one of said elongated openings along the centrally disposed inner edges of said panels from the top of the garment to approximately the pubic area of the patient, and provided with cooperating pads of a VELCRO type fastening material at the plurality of levels adjacent to the free edges of the panels, (b) the rear portion of said garment composed of two panels of sheet material separable at the other one of said elongated openings along the centrally disposed inner edges of said last-mentioned panels from the top of the garment to approximately the lumbar region of the back of the patient, and provided with cooperating pads of VELCRO type fastening material adjacent to the free edges of the panels, and (c) said portions merging into a continuous flared tent section at the bottom of said robe with a pair of symmetrical pleats extending at the front thereof from the pubic area of the patient to the bottom thereof, to permit the extensive distention of the gown during pelvic examinations to eliminate the need for any additional covering sheeting in the course of such examination.

2. A robe as set forth in claim 1, wherein the elongated opening between the two panels of the rear portion is shorter than that between the two panels of the front portion.

3. A robe as set forth in claim 1, wherein the elongated opening between the two panels of the front portion is nearly twice as long as the opening in the rear portion.

4. A robe as set forth in claim 3, wherein the length of the symmetrical pleats at the bottom of the front of the robe is approximately only seventy-five percent of the length of the elongated opening thereabove.

5. A robe as set forth in claim 4, wherein the distention of the pleats at the lower portion of the garment increases the length of the bottom edge approximately three feet.

6. A robe as set forth in claim 4, wherein the front and back portions flaring from the bottoms of the arm-holes terminate in a continuous circumferential bottom edge of approximately ten feet.

7. A robe as set forth in claim 5, wherein the distended pleated portion of the robe in conjunction with the bottom edges of the front and back portions combine to form a continuous bottom edge having a length in excess of approximately four yards.

8. A robe as set forth in claim 7, wherein the robe is fabricated from a colored and readily launderable textile fabric.

9. A robe as set forth in claim 8, wherein the free edges of the robe are bound with an ornamental fabric tape harmonizing with the color of the robe to enhance the appearance and durability thereof.

* * * * *